US011118454B2

(12) United States Patent
Gerhardt et al.

(10) Patent No.: US 11,118,454 B2
(45) Date of Patent: Sep. 14, 2021

(54) TUNNEL BORING DEVICE AND SYSTEM FOR THE HYDRAULIC REMOVAL OF CUTTINGS, AND SYSTEM FOR PRODUCING A STABLE FLUID PRESSURE FOR A BORING FLUID IN THE REGION OF A CUTTING DISK OF THE TUNNEL BORING DEVICE

(71) Applicant: HERRENKNECHT AG, Schwanau (DE)

(72) Inventors: Tobias Gerhardt, Teningen (DE); Michael Lubberger, Schwanau (DE)

(73) Assignee: Herrenknecht AG, Schwanau (DE)

( * ) Notice: Subject to any disclaimer, the term of this patent is extended or adjusted under 35 U.S.C. 154(b) by 0 days.

(21) Appl. No.: 16/073,565

(22) PCT Filed: Jan. 27, 2017

(86) PCT No.: PCT/EP2017/051816
§ 371 (c)(1),
(2) Date: Jul. 27, 2018

(87) PCT Pub. No.: WO2017/133986
PCT Pub. Date: Aug. 10, 2017

(65) Prior Publication Data

US 2019/0032430 A1 Jan. 31, 2019

(30) Foreign Application Priority Data

Feb. 1, 2016 (DE) ..... 10 2016 001 032.0

(51) Int. Cl.
*E21D 9/087* (2006.01)
*E21D 9/13* (2006.01)
(Continued)

(52) U.S. Cl.
CPC ..... *E21D 9/087* (2013.01); *E21D 9/04* (2013.01); *E21D 9/13* (2013.01); *E21B 7/046* (2013.01); *E21B 21/08* (2013.01); *E21D 9/06* (2013.01)

(58) Field of Classification Search
CPC ..... E21D 9/0642; E21D 9/065; E21D 9/08; E21D 9/087; E21D 9/04; E21D 9/06;
(Continued)

(56) References Cited

U.S. PATENT DOCUMENTS 3,946,605 A * 3/1976 Yamazaki ..... E21B 21/08 73/152.42
4,052,859 A * 10/1977 Iwamitsu ..... E21D 9/005 405/144
(Continued)

FOREIGN PATENT DOCUMENTS

CA 2886767 A1 4/2014
CN 102278119 B 12/2011
(Continued)

OTHER PUBLICATIONS

English language machine translation of Tayama et al., Japanese patent publication No. JP-11182182-A, published Jul. 6, 1999 (9 pages) (Year: 1999).*

*Primary Examiner* — Janine M Kreck
*Assistant Examiner* — Michael A Goodwin
(74) *Attorney, Agent, or Firm* — Mark Rodgers

(57) ABSTRACT

A tunnel boring device for laying a pipeline in the ground using a boring tool, having; a feed line for supplying a boring fluid to the boring tool; a section, arranged at the rear of the boring tool, for receiving the ground cuttings, wherein the region of the boring tool and the section are filled with boring fluid, with a pressure that corresponds to the pressure in the ground; at least a jet pump for removing the boring fluid mixed with the cuttings; at least one conveying line for
(Continued)

Figure 1:
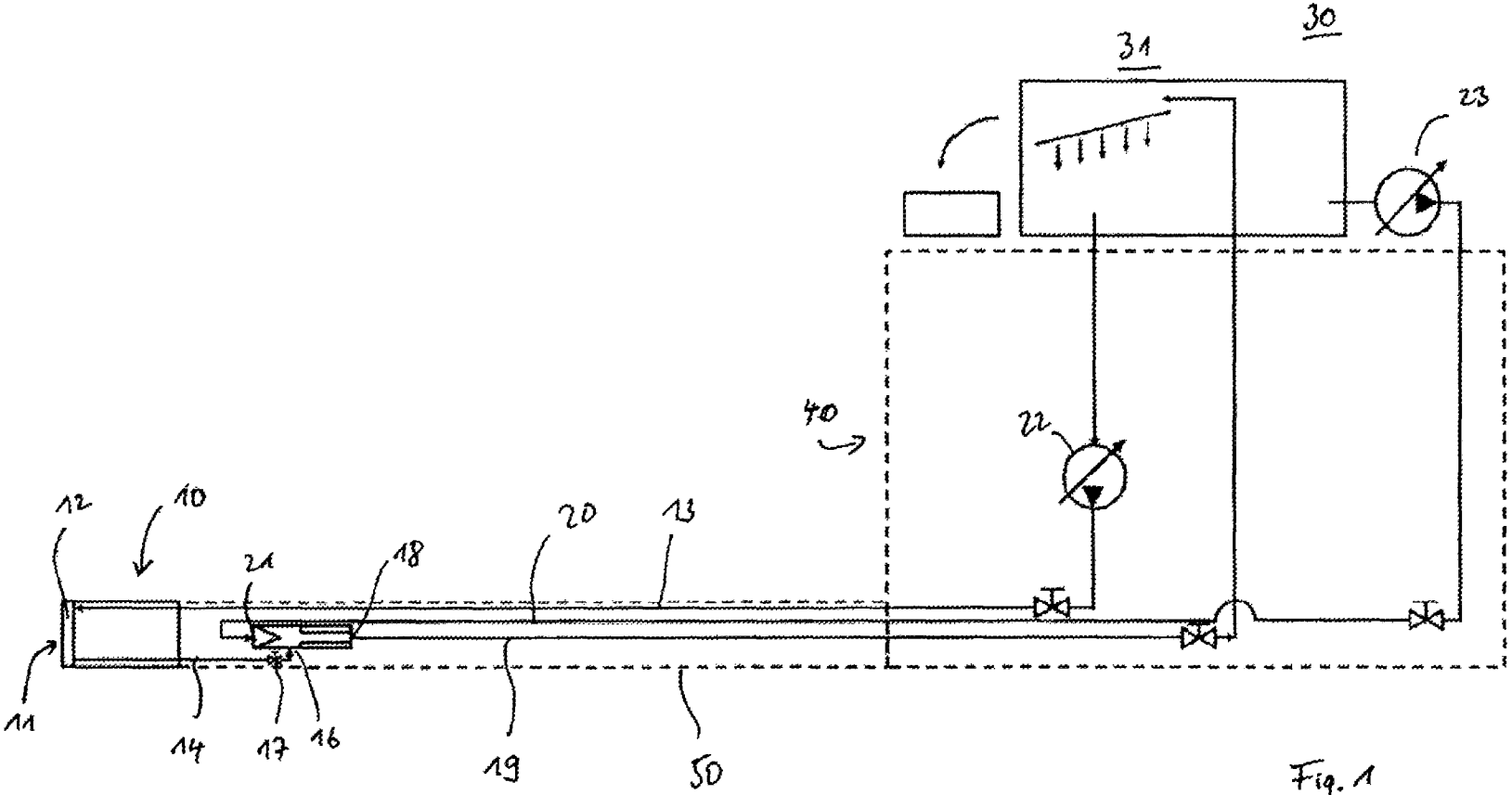

removing the boring fluid mixed with cuttings, this line being connected to the delivery side of the pump connected to the section via a suction line. The jet pump is connected to a drive line via which a driving fluid is supplied to the jet pump; the pump is arranged outside then section; and the suction line contains a shutoff valve.

7 Claims, 8 Drawing Sheets

(51) Int. Cl.

| | |
|---|---|
| ***E21D 9/04*** | (2006.01) |
| *E21D 9/06* | (2006.01) |
| *E21B 7/04* | (2006.01) |
| *E21B 21/08* | (2006.01) |

(58) Field of Classification Search
CPC . E21D 9/13; E21B 21/08; E21B 21/10; E21B 21/103; E21B 21/12; E21B 7/046
See application file for complete search history.

(56) References Cited

U.S. PATENT DOCUMENTS 6,142,577 A * 11/2000 Tayama ..... E21D 9/13 299/56
2017/0045156 A1 2/2017 Lubberger et al.

FOREIGN PATENT DOCUMENTS

| | | | | |
|---|---|---|---|---|
| DE | 4213987 | A1 | | 11/1993 |
| EP | 0208816 | B1 | | 1/1987 |
| JP | S6078097 | A | | 5/1985 |
| JP | S60152799 | A | | 8/1985 |
| JP | H0762384 | B2 | | 7/1995 |
| JP | 3439005 | B2 | | 5/1997 |
| JP | H09132994 | A | | 5/1997 |
| JP | H07310495 | A | | 8/1997 |
| JP | H094375 | A | | 10/1997 |
| JP | 11182182 | A | * | 7/1999 |
| JP | 2001182486 | A | | 7/2001 |
| JP | 2001288981 | A | * | 10/2001 |
| JP | 2007031947 | A | * | 2/2007 |

* cited by examiner

TUNNEL BORING DEVICE AND SYSTEM FOR THE HYDRAULIC REMOVAL OF CUTTINGS, AND SYSTEM FOR PRODUCING A STABLE FLUID PRESSURE FOR A BORING FLUID IN THE REGION OF A CUTTING DISK OF THE TUNNEL BORING DEVICE

The invention relates to a tunnel boring device for creating a bore from a starting point to a target point in the ground along a predefined boring line by advancing the tunnel boring device in order to create a tunnel or in order to lay a pipeline in the ground using a boring tool to break up the ground, having at least one feed line for supplying a boring fluid to the boring tool, having at least one section, arranged on the rear side of the boring tool, for receiving the broken-up ground which is present in the form of cuttings, wherein the region of the boring tool and the at least one section are substantially filled with boring fluid, and the boring fluid is provided in the region of the boring tool and within the at least one section with a pressure which substantially corresponds to the pressure prevailing in the ground at the heading face, having at least one pump for removing, from the section, the boring fluid mixed with the cuttings, and having at least one conveying line for removing, from the bore, the boring fluid mixed with cuttings, said line being connected to the delivery side of the at least one pump, and wherein the at least one pump is connected to the at least one section via at least one suction line. The invention further relates to a system for the hydraulic removal of cuttings. The invention further relates to a system for producing a stable fluid pressure for a boring fluid in the region of a cutting disk of a tunnel boring device designed for wet boring at a heading face.

When driving bores from a starting point to a target point along a predefined boring line, use is made of a variety of tunnel boring machines in dependence on the in-situ ground or rock. Such tunnel boring machines are used when the tunnel boring machine is advanced along the boring line without a pilot bore or the like. The advancement can occur either by pressing forward against abutments in the already created tunnel or by the pipe segments themselves being pushed from the front or behind outside the created tunnel. Even complete pipelines can, possibly even only in a partially prepared form, be used for advance. Such an advance then occurs by means of an advancing device, for example a so-called pipe thruster or a press frame if individual pipe segments are pressed into the ground. Here, the ground is broken up by a boring tool, for example a cutting disk. The released cuttings are brought through the boring tool into a region behind the cutting disk and removed from there.

The selection of the type of tunnel boring machine depends on the geology. If the ground in which the tunnel is to be created consists substantially of unstable rock, use is made of a wet boring method in which a heading face support for stabilizing the bore and the surrounding ground is used. For this purpose, boring fluid is introduced in the region of the cutting disk, and the space between the heading face and cutting disk is filled with the boring fluid. The boring fluid which is provided in the region of the boring tool is placed under pressure in order to counteract the pressure of the water that prevails in the rock and thus to stabilize the heading face.

Known for this purpose are tunnel boring machines in which the heading face and the section for receiving cuttings that is arranged behind the boring tool are filled with a boring fluid in the form of boring mud. The boring fluid is usually a bentonite suspension. The boring fluid mixed with cuttings is sucked by means of a centrifugal pump out of the section via a suction line and conveyed to the surface through the tunnel behind the tunnel boring machine through a conveying line. Also present is a feed line through which boring fluid is supplied to the heading face, again via a pump.

If stable rock is present, it is possible to operate without a heading face support. This means that the region of the heading face and the section behind the boring tool are not completely filled with boring fluid. Instead, the boring fluid is used to bind dust and cuttings. The conveyance away from the section can occur in various ways. For this purpose, use is made, inter alia, of screw conveyors or conveyor belts.

A further possibility of conveying away the released cuttings is provided by the use of jet pumps which are arranged directly in the section behind the boring tool. The cuttings drop into a type of funnel above the jet pump, from which the jet pump then sucks in the cuttings. The cuttings are then mixed in the mixing chamber of the jet pump with a driving medium for driving the jet pump (driving fluid, usually identical to the boring fluid) and then removed. For this purpose, there is a need to provide a driving line by means of which the driving medium as such is then supplied to the jet pump. The rapid jet, which is accelerated by a nozzle in the jet pump, of the driving medium entrains the cuttings from the funnel. The cuttings and driving fluid are mixed in a mixing chamber of the jet pump and pass from there into the conveying line via a mixing pipe.

A further possibility for suction in a jet pump is obtained via an open tank system in which the funnel is configured as an open basin in the suction region of the jet pump, in which boring fluid is provided. During the operation of the jet pump, boring fluid is supplied to the basin, such that the basin does not become dry in spite of the suction and removal by the jet pump. The released cuttings and the bound dust drop into the basin and are there sucked in by the jet pump. Such a device for stable rock is known from EP 0208816 B1. Furthermore known, such devices for stable rock are known from JP H09-132994 A, JP H02-32437 B, JP H07-62384 Y and JP 2001-182486 A.

JP H07-6238 Y and JP 2001-182486 A each additionally disclose a tunnel boring machine whose use is possible not only in stable rock with an above-described open system in conjunction with a jet pump but alternatively also in an unstable rock which requires a heading face support by a cleaning fluid. There is provision here that, in stable rock, the cuttings are removed via a jet pump integrated in the section behind the boring tool. In unstable rock in which a heading face support is used, what happens instead is that the jet pump is closed and the delivery is performed via a centrifugal pump which is arranged in the feed line and which, in JP 2001-182486A, is arranged outside the tunnel, for example in the shaft or on the surface. The centrifugal pump pumps the feeding fluid into the boring region and then pumps, the boring mud mixed with the cuttings via the conveying line out of the boring region. A use of a jet pump in wet operation is not shown.

It is disclosed in DE 69708852 T2 (aka U.S. Pat. No. 6,142,577A) that, with reference explicitly to stable rock, the jet pump can be replaced in dry operation by a centrifugal pump. According to DE 69708852 T2, a jet pump in dry operation in stable rock is efficient only for small boring diameters. In the case of larger boring diameters, the jet pump cannot be operated economically due to the losses arising in it. Furthermore, the jet pumps according to this document have the disadvantage that the delivery rate is not variable and cannot be readily increased to a greater value if this is required.

The open jet pump systems described further disclose a separation of air which, occasioned by the open system, is present in the boring fluid mixed with cuttings. For this purpose, there is disclosed a separator already after a short distance in the tunnel itself, onto which the jet pump delivers. If air is present in the conveying line, the cuttings can be spontaneously deposited into air locks in the conveying line and block the latter. Furthermore, it is thereby possible to minimize the high pressure losses in the jet pump in that, since only small delivery lengths have to be bridged by the jet pump, the pressure in the driving line can be kept lower. The removal of the cuttings from the separation tank then occurs with a centrifugal pump.

Practice has shown that it is expedient to provide centrifugal pumps for removing cuttings-laden boring fluid in the tunnel behind the section in order to have a short suctioning and to achieve corresponding high delivery outputs which are necessary during the creation of the bore. If appropriate, it is necessary to provide further pumps in the tunnel or in the pipeline to increase the delivery outputs. Specifically in the case of small diameters which are possibly not accessible, it is difficult to provide high-output centrifugal pumps which can be arranged on account of their overall height in the possibly restricted diameter of the pipeline. Furthermore, centrifugal pumps are maintenance-intensive. For this reason, it has been customary for many years in the case of bores of small diameter to provide centrifugal pumps outside the borehole in order to correspondingly allow the pump to be able to be reached for maintenance purposes or to be able to provide adequate delivery rates with the centrifugal pump. This has the disadvantage that the driving lengths are limited on account of the limitation of the suction power of the centrifugal pump.

It is an object to provide a tunnel boring machine and a system for the hydraulic removal of cuttings by means of which it is possible, specifically for relatively small diameters, in particular for diameters which are not accessible, to achieve relatively large driving lengths.

Also known for this purpose are tunnel boring machines in which the heading face and the section, arranged behind the boring tool, for receiving cuttings are filled with a boring fluid in the form of boring mud. The boring fluid is usually a bentonite suspension. The boring fluid is introduced into the region of the heading face by a feed pump via a feed line, and the boring fluid is placed under the necessary pressure for supporting the heading face. It is important when supporting the heading face that the heading face supporting pressure is kept constant, in particular in order, in the case of little overlying ground, to avoid blowouts to the surface under excessive pressure or intrusions of moisture from the rock or uncontrolled afterflow of rock into the bore.

There is known, inter alia, from DE 42 13 987 A1 a tunnel boring device with a heading face support in which the section for receiving cuttings behind the cutting disk is subdivided by a wall into two spaces which are in fluid communication with one another. The space facing the cutting disk and also the region of the heading face are filled with boring fluid. The partially separated-off space is filled only partially with fluid. Compressed air as a type of cushion is introduced into this space. This serves as pressure equalization for keeping the heading face pressure constant. In this way, the heading face pressure can be very finely regulated. Sensor systems for monitoring the prevailing pressure are correspondingly provided in the region of the cutting disk and in the section behind the cutting disk.

During the boring operation, boring fluid mixed with the cuttings is sucked in by means of a delivery pump from the section via a suction line and conveyed to the surface through the tunnel behind the tunnel boring machine through a conveying line. Where appropriate, processing stages are already interposed in the tunnel or else use is made of a plurality of delivery pumps to ensure the total delivery to the surface. The delivery pumps used are centrifugal pumps.

The delivery of the cuttings and the removal of boring fluid from the section directly influences the heading face pressure. It must be ensured that at least as much feeding fluid can be supplied as is removed. Here, too, the provision of the compressed air cushion serves as pressure equalization. However, it is correspondingly necessary to provide a compressed air supply.

However, a heading face support is also possible without the provision of compressed air in conjunction with the chamber division. Here, it is necessary for the frictionless boring progression that the driver of the tunnel boring device reacts in good time to pressure changes. For this purpose, the advancing rate, the delivery pressures or delivery rates and the feeding pressures and feeding rates must be adequately monitored and regulated. This requires a great deal of experience and attentiveness on the part of the machine driver.

A further object is to provide a tunnel boring machine and a system by means of which it is possible to keep the heading face pressure of the boring fluid constant in a simpler manner.

These objects are achieved with regard to the tunnel boring machine in that the pump is a jet pump which is connected to a driving line via which a driving fluid is supplied to the jet pump, in that the at least one pump is arranged outside the at least one section, and in that at least one shut-off valve via which the suction line can be closed is provided in the at least one suction line.

With regard to the first object, it has been shown in a surprising manner that it is possible, counter to the prevailing opinion of those skilled in the art, to use jet pumps even during wet boring with a tunnel boring machine with heading face support. The pressure on the heading face remains stable. Furthermore, it is possible with the jet pump to carry out delivery of the cuttings-laden boring fluid via the conveying line to the shaft or to the surface without providing a further pump or an intermediate station.

With regard to the further object, it has been shown in a surprising manner that it is possible, by the provision of a jet pump in conjunction with at least one further regulating element, to keep the pressure at the heading face stable in a particularly simple manner. Furthermore, it is possible with the jet pump to carry out delivery of the cuttings-laden boring fluid via the conveying line to the shaft or to the surface without providing a further pump or an intermediate station. If a pressure is set at the heading face and if the outputs of the delivery pump and the feed pump are set at least with more delivery than is necessary for the current advancing rate, there is thus obtained in a surprising manner the possibility of upwardly or downwardly varying the advancing rate in dependence on the geological conditions within the region without simultaneously having to adapt the delivery rates/delivery pressures of the pumps. The heading face pressure is influenced thereby in a nonrelevant manner.

A further teaching of the invention provides that a connection line is provided between the feed line and suction line, which line can preferably be closed by a shut-off valve.

The provision of the connection line makes it possible, during starting of the tunnel boring device, to avoid fluctuations or large pressure peaks or pressure drops on the heading face and thus on the heading face supporting pressure which can arise by the abrupt closing and opening of the shut-off valves in the feed line and/or suction line.

A further teaching of the invention provides that a shut-off valve is provided in the feed line. This makes it possible in a simple manner to separate the region of the heading face from the remaining line system.

A further teaching of the invention provides that a regulating device, preferably a control valve, from which the feed line leads away is provided in the driving line and via which the volumetric flow of the boring fluid in the feed line can be set. It is thereby possible, only with one line and one pump, to supply the jet pump with driving fluid and at the same time also to supply the heading face with feeding fluid.

A further teaching of the invention provides that the pump is connected to a high-pressure pump via the driving line. The provision of high pressures in the driving line makes it possible for the boring fluid mixed with cuttings to be conveyed over greater distances through the conveying line.

A further teaching of the invention provides that the boring fluid and/or the driving fluid are/is a bentonite suspension. This is in particular processed by a separation unit so that it can be used in a circulating arrangement.

The first object is achieved with regard to the system for the hydraulic removal of cuttings released by a tunnel boring device, preferably according to an above-described tunnel boring device, wherein the tunnel boring device is designed for wet boring with heading face pressure regulation and has a section for receiving the released cuttings, by a system having a feed line for supplying boring fluid to the section, having a suction line for removing boring fluid mixed with cuttings, having a jet pump for removing the boring fluid mixed with cuttings, having a driving line which is connected to the driving line connection of the jet pump, wherein the driving fluid is conveyed to the jet pump by a driving pump, and having a connection line between the feed line and the suction line, wherein at least one shut-off element is provided in each case in the suction line, the feed line and the connection line.

The further object is achieved with regard to the system for producing a stable fluid pressure for a boring fluid in the region of a cutting disk of a tunnel boring device designed for wet boring, preferably according to an above-described tunnel boring device, at a heading face which is present during the creation of a bore from a starting point to a target point in the ground along a predefined boring line by advancing the tunnel boring device in order to create a tunnel or in order to lay a pipeline, wherein the tunnel boring device has a section, behind the cutting disk, for receiving the cuttings released by the cutting disk, a feed line for supplying boring fluid to the heading face, a suction line for removing, from the section, boring fluid mixed with cuttings, a jet pump for removing the boring fluid mixed with cuttings, a driving line which is connected to the driving line connection of the jet pump, wherein the driving fluid is conveyed to the jet pump by a driving pump, and a connection line between the feed line and the suction line, wherein at least one shut-off element is provided in each case in the suction line, the feed line and the connection line.

Figure 2:
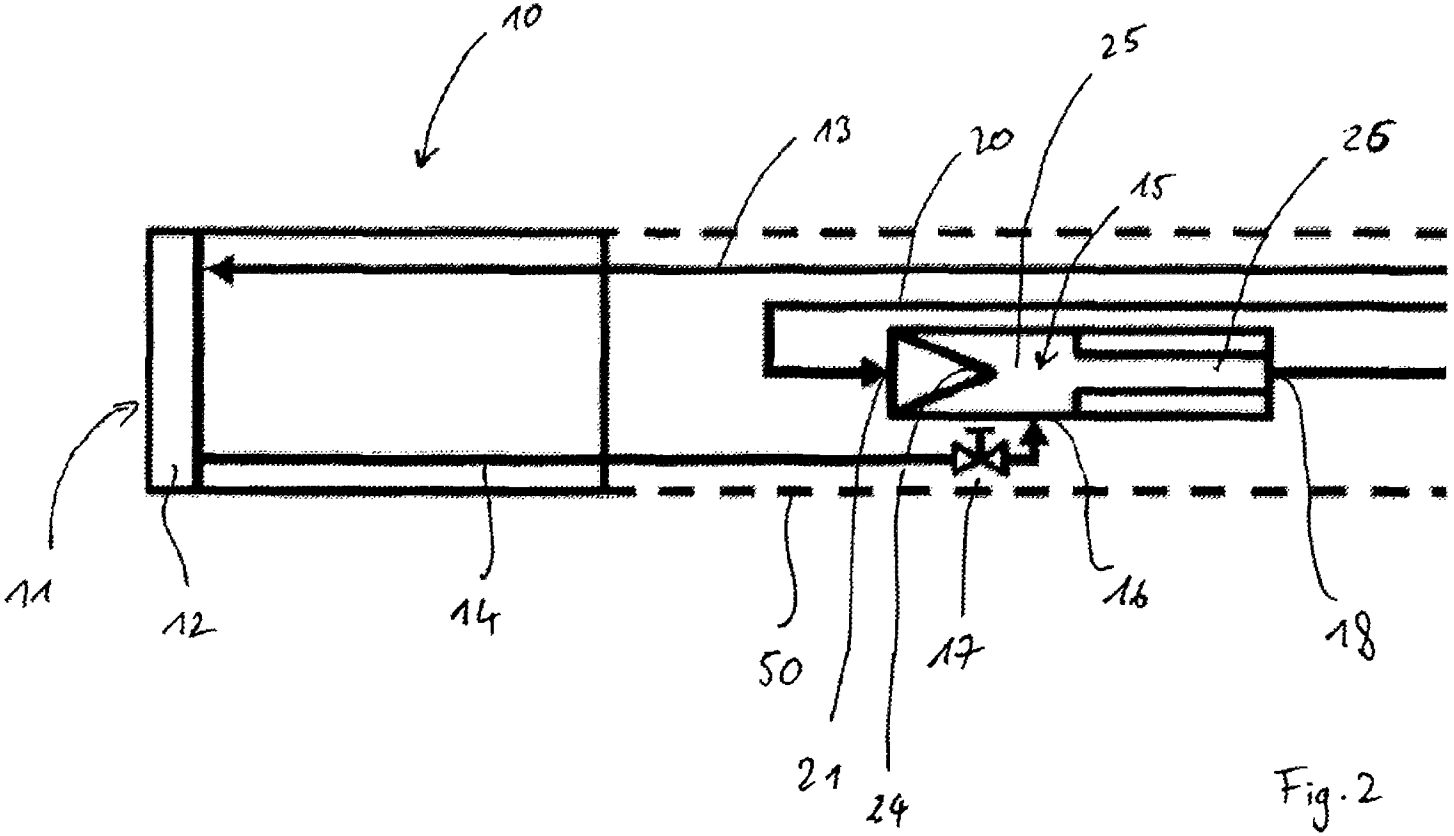
Figure 3:
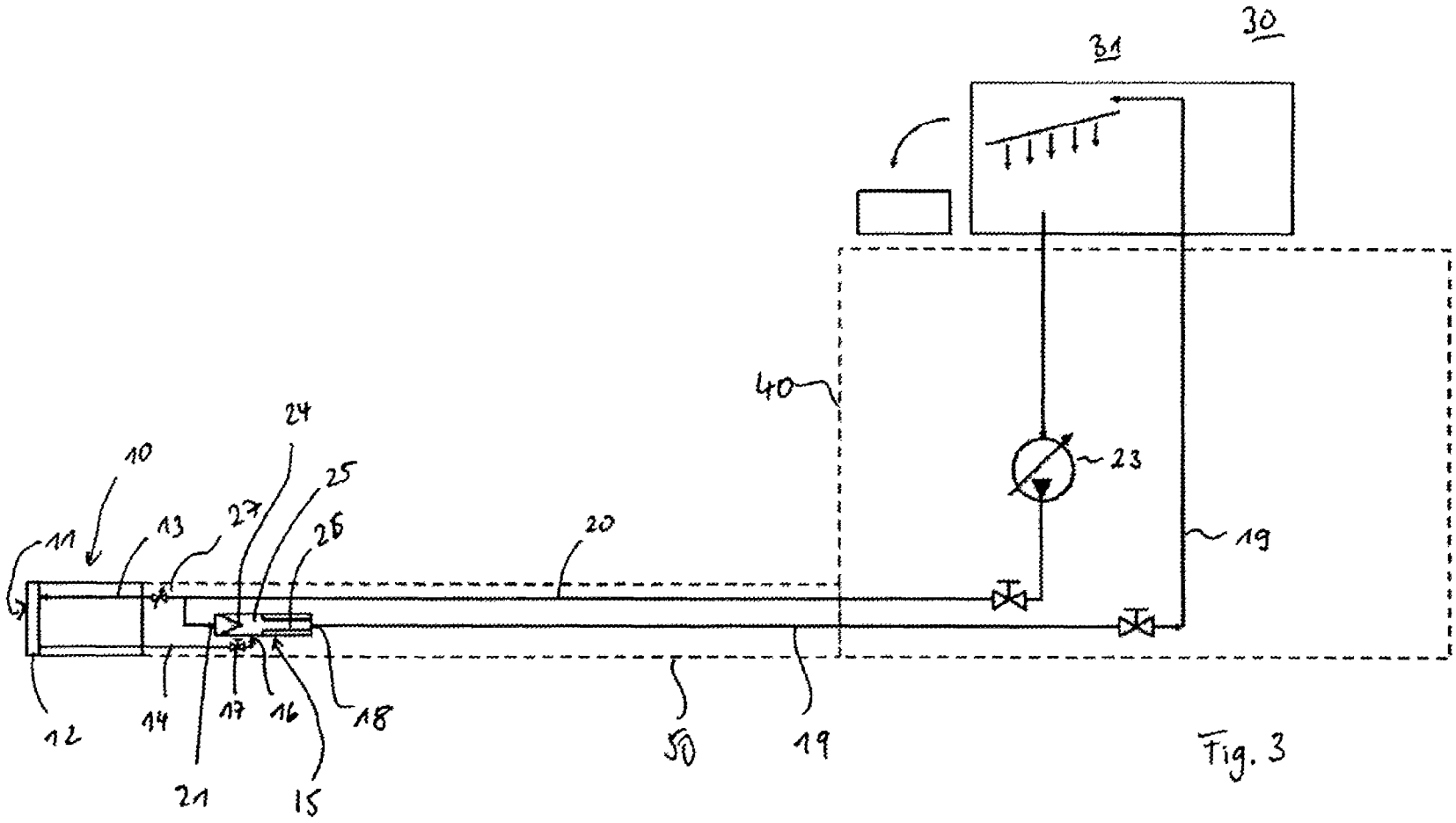
Figure 4:
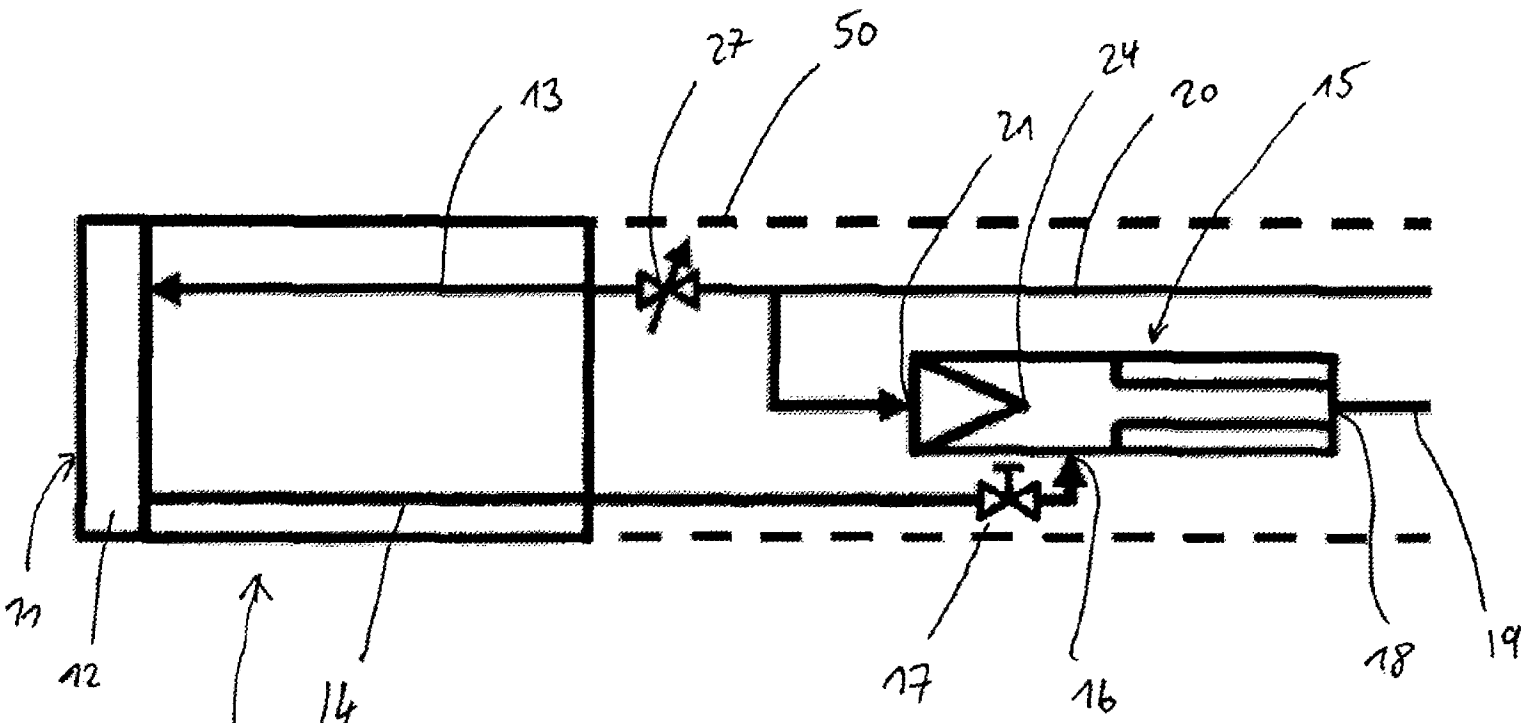
Figure 5:
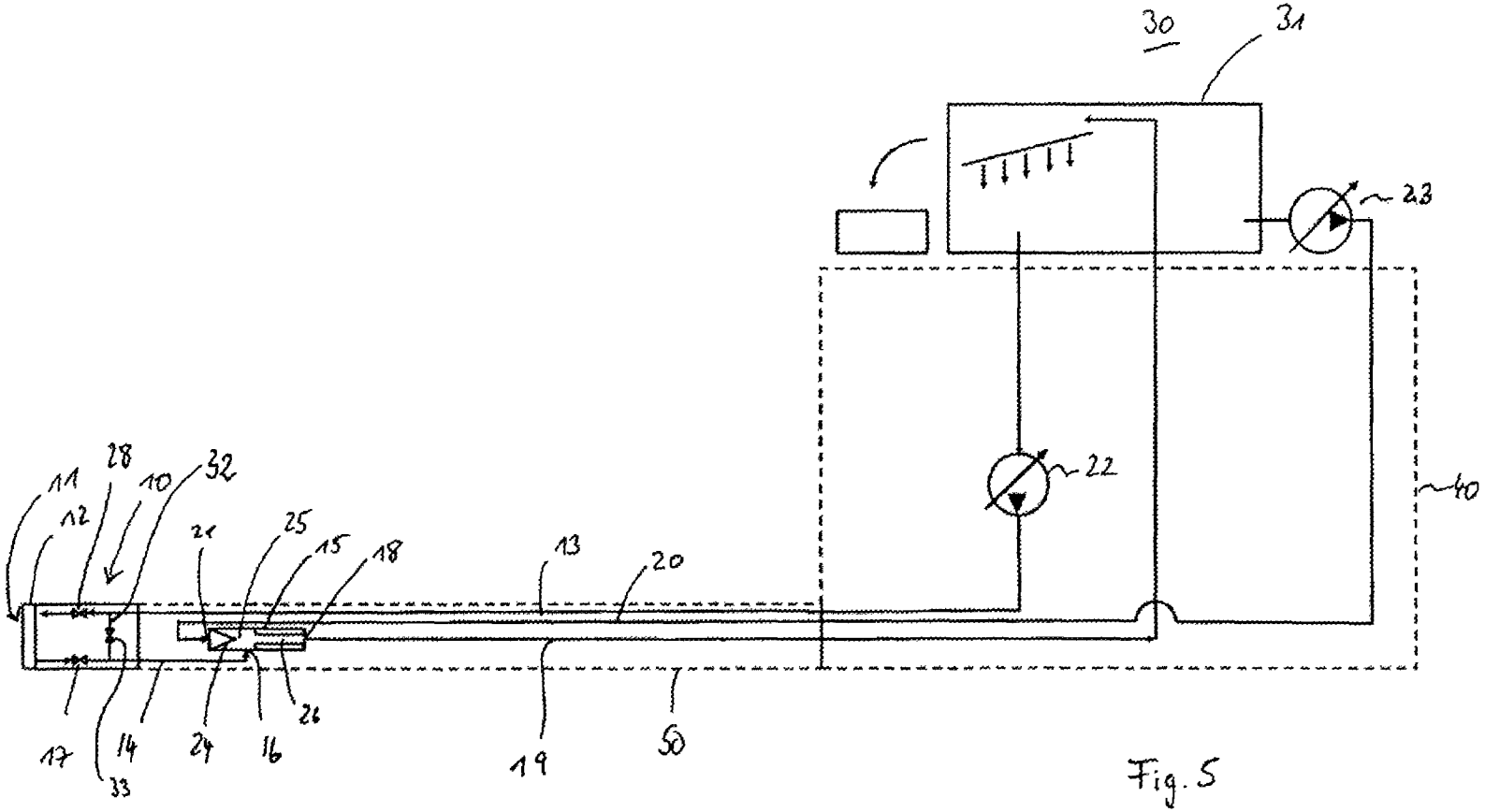
Figure 6:
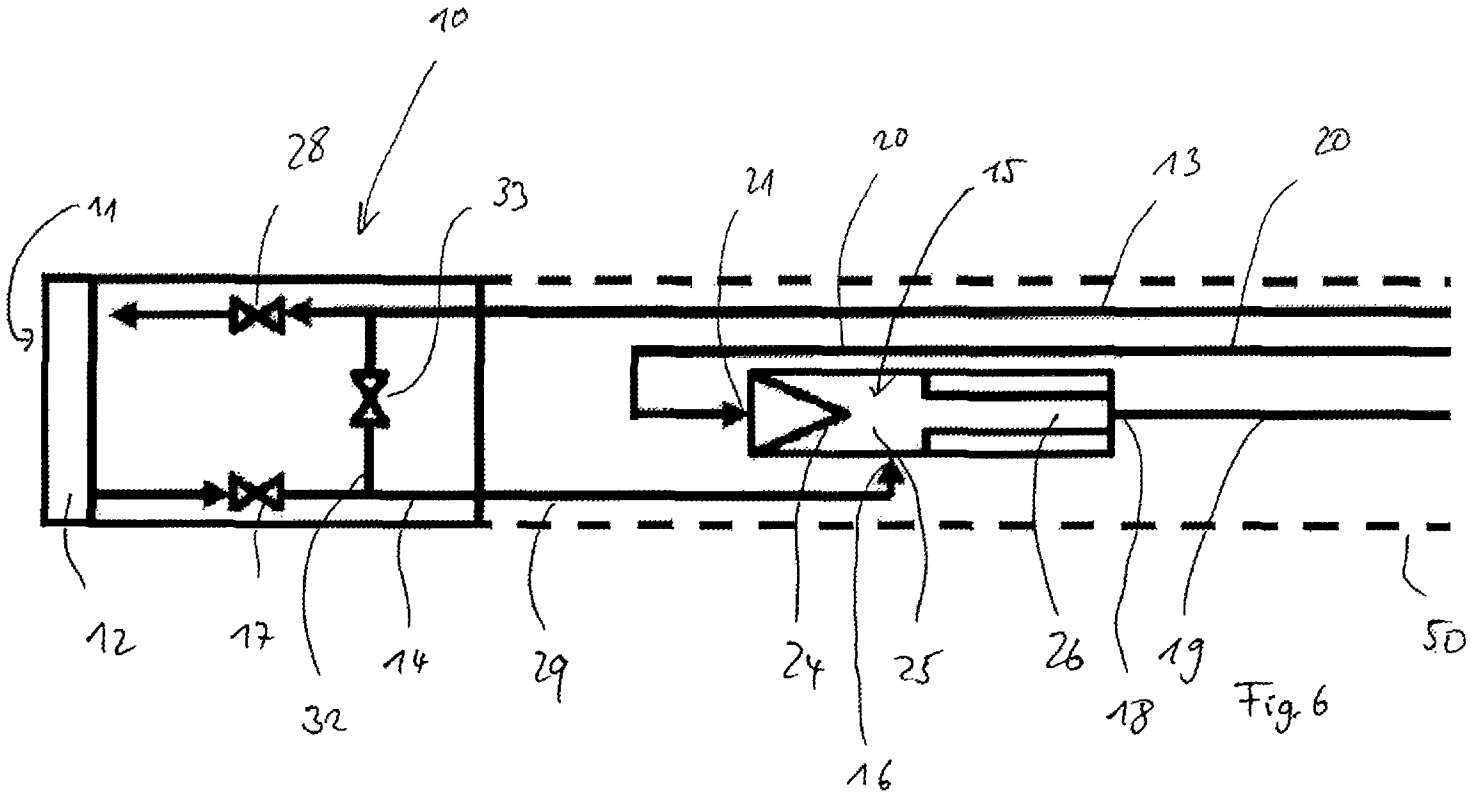
Figure 7:
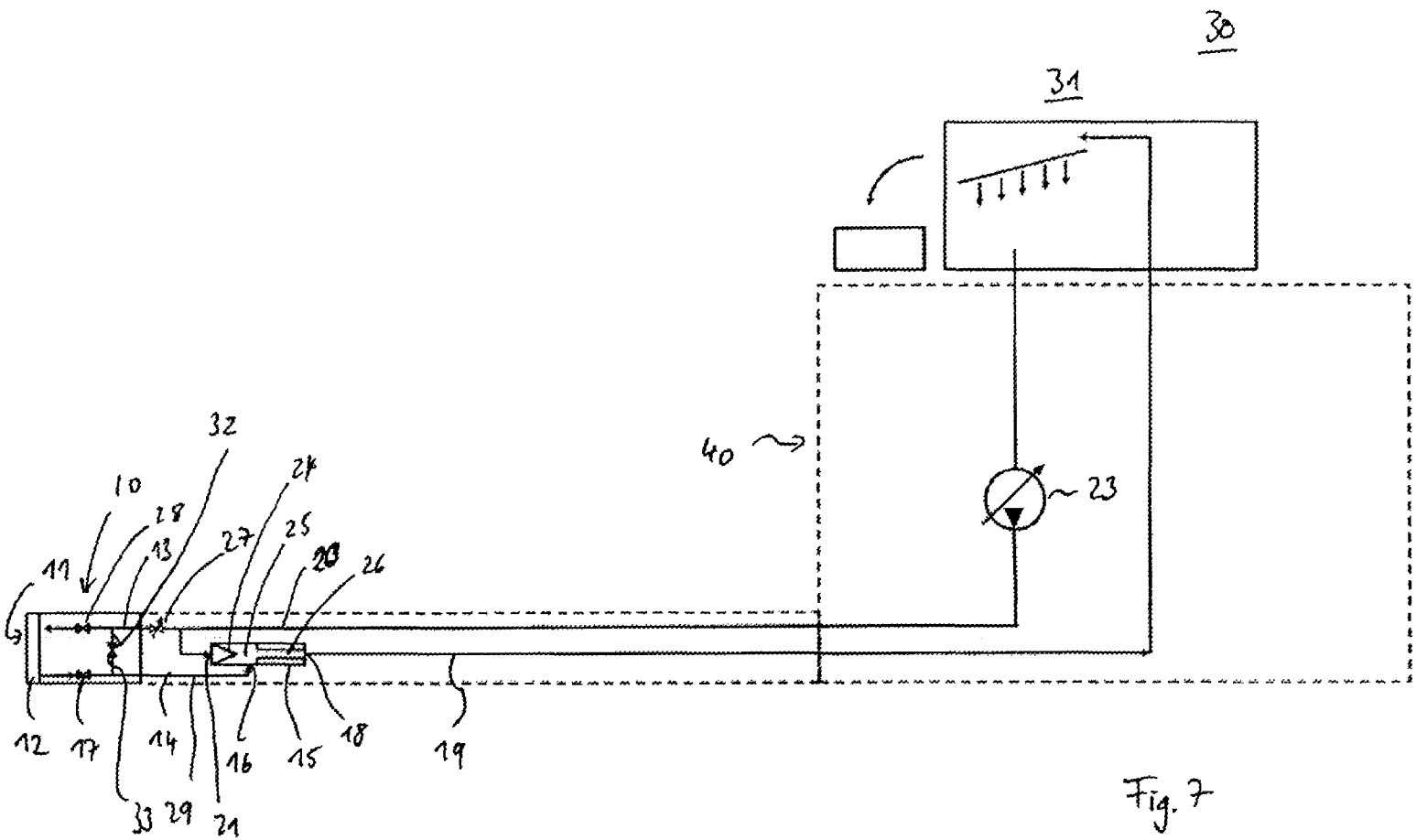
Figure 8:
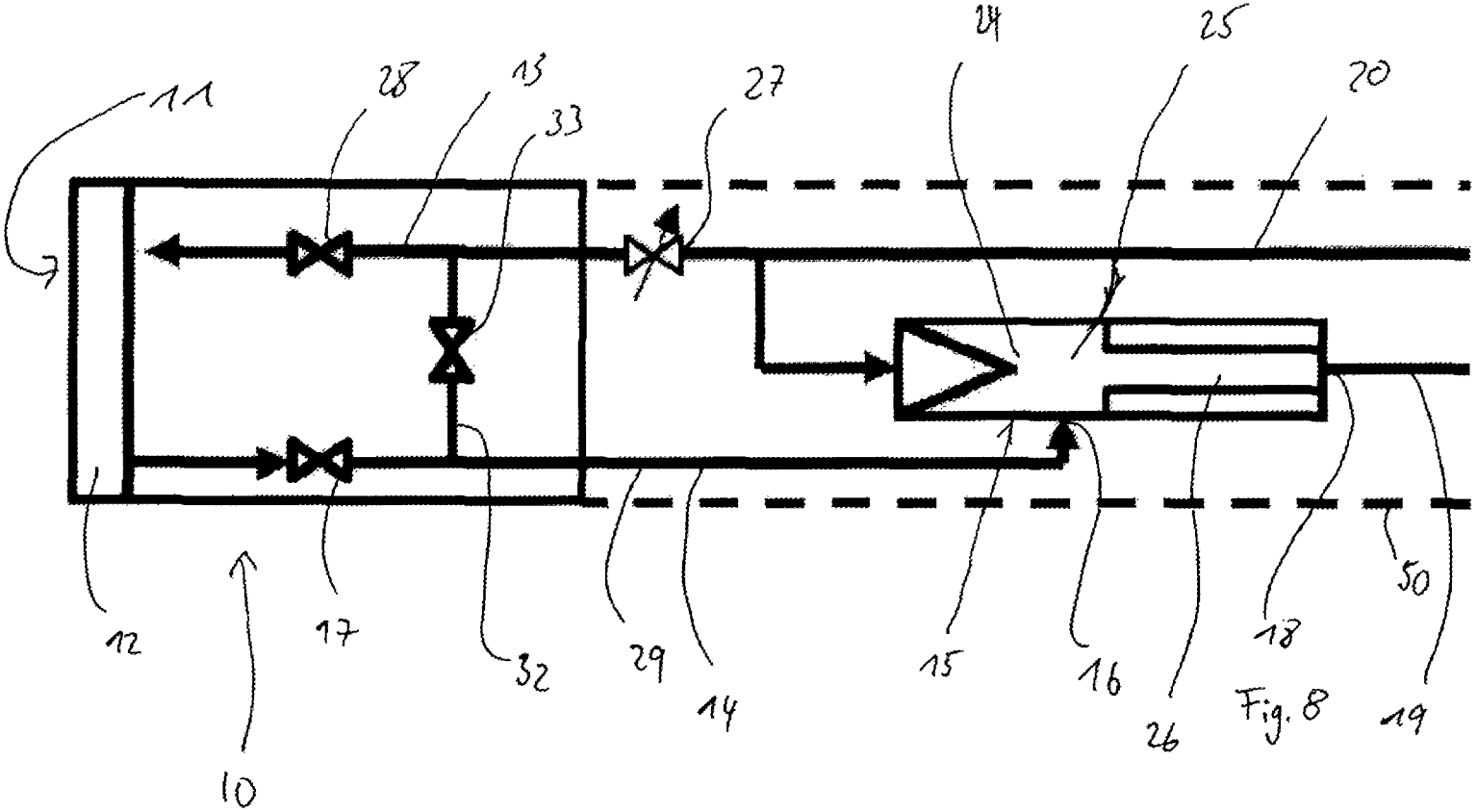

The invention will be explained in more detail below with reference to an exemplary embodiment in conjunction with a drawing, in which:

FIG. 1 shows a schematic illustration of a first embodiment according to the invention, FIG. 2 shows an enlarged illustration of FIG. 1, FIG. 3 shows a schematic illustration of a second embodiment according to the invention, FIG. 4 shows an enlarged illustration of FIG. 3, FIG. 5 shows a schematic illustration of a third embodiment according to the invention, FIG. 6 shows an enlarged illustration of FIG. 5, FIG. 7 shows a schematic illustration of a fourth embodiment according to the invention, and FIG. 8 shows an enlarged illustration of FIG. 7.

FIG. 1 shows a first embodiment according to the invention of the tunnel boring device 10 according to the invention. A shaft 40 is schematically illustrated in FIG. 1. Also illustrated are surface installations 30 and the already created bore and the tunnel constructed therein or the pipeline 50 introduced therein.

The tunnel boring device 10 comprises a schematically illustrated cutting disk 11 as boring tool. Provided behind the cutting disk 11 is a section 12 in which the cuttings (not shown) released by the cutting disk 11 collect. The region of the cutting disk 11 and of the section 12 is filled with a boring fluid (not shown), here in the form of a bentonite mud, for example.

The region of the cutting disk 11 at the heading face (not shown) and the section 12 are connected to a feed line 13. The boring fluid is supplied to the region of the cutting disk 11 and to the section 12 by the feed line 13. Furthermore, the section 12 is connected to a suction line 14. The suction line 14 is connected to a suction connection 16 of a jet pump 15. A shut-off valve 17 is provided in the suction line 14. A conveying line 19 is provided on the delivery connection 18 of the jet pump 15. Furthermore, the jet pump 15 has a driving line connection 21 for a driving line 20.

The feed line 13 extends from the surface installations 30 or from the shaft 40 through the already introduced pipeline or the already created tunnel 50. A feed pump 22 is provided in the feed line 13. This pump can be provided in the region of the surface installations 30 or in the shaft 40. A driving pump 23, which is configured as a high-pressure pump, is connected to the driving line 20. The conveying line 19 is connected to a separation unit 31 for separating the boring fluid from the cuttings. The feed pump 22 and the driving pump 23 are supplied with boring fluid from the separation unit 31 and then once again deliver said fluid to the cutting disk 11 or to the jet pump 15 via the feed line 13 or driving line 20.

In operation, the region of the cutting disk 11 at the heading face and the section 12 are supplied with boring fluid by the feed pump 22 by the feed line 13. The jet pump 15 is likewise supplied with boring fluid by the driving pump 23 by the driving line 20. The driving fluid enters the jet pump 15 through the driving line connection 21. The driving fluid then passes to the driving nozzle 24 and through it, being accelerated in so doing, into the mixing chamber 25. The boring fluid, which fills the mixing chamber 25, is transported into a mixing pipe 26 as a result of the acceleration in the driving nozzle 24. Here, the thus accelerated boring fluid entrains the boring fluid located in the suction connection 16 and thus correspondingly also the boring fluid, which is located in the suction line 14, into the mixing chamber 25, with the result that the jet pump 15 then sucks in the boring fluid and the cuttings from the section 12 via the suction line 14. The boring fluid present as driving fluid together with the fluid from the suction line consisting of cuttings and boring fluid is then mixed in the mixing chamber 25 and transported into the conveying line 19 via the mixing pipe 26.

To start the boring device, the shut-off valve 17 in the suction line 14 is first closed. The boring fluid in the driving line 20 is then supplied to the jet pump 15 via the driving pump 23. The acceleration which the boring fluid experiences in the driving nozzle 24 causes the boring fluid to be transported into the conveying line and through it to the separation unit 31. In the region of the suction connection 16 there is formed a negative pressure once the operation of the pump has properly adjusted itself. This negative pressure has the effect that, if the shut-off valve 17 is opened, the boring mud located in the suction line 14 is sucked directly into the pump 15. The cuttings released during the advance of the tunnel boring device 10 are then transported into the section 12 and mixed therein with the boring fluid. The mixture of cuttings and boring fluid is correspondingly sucked in by the jet pump 15 through the suction line 14.

To start the boring device, the shut-off valve 17 in the suction line 14 is also first closed. The feed pump 22 is started and the region of the cutting disk 11 is supplied with boring fluid until the desired pressure is present at the heading face. The boring fluid in the driving line 20 is then supplied to the jet pump 15 via the driving pump 23. The acceleration which the boring fluid experiences in the driving nozzle 24 causes the boring fluid to be transported into the conveying line and through it to the separation unit 31. In the region of the suction connection 16 there is formed a negative pressure once the operation of the pump has properly adjusted itself. This negative pressure has the effect that, if the shut-off valve 17 is opened, the boring mud located in the suction line 14 is sucked directly into the pump 15. After opening the shut-off valve 17, the pressure at the heading face is readjusted by regulating the feed pump, if required. The cuttings released during the advance of the tunnel boring device 10 are then transported into the section 12 and mixed therein with the boring fluid. The mixture of cuttings and boring fluid is correspondingly sucked in by the jet pump 15 through the suction line 14. Here, the density and the friction losses in the conveying line 19 increase. At the same time, the suction power of the jet pump 15 drops if the pressure at the nozzle remains the same. For this reason, either the pressure and thus the volumetric flow at the driving nozzle 24 must be increased by means of the driving pump 23, which requires a direct regulation, in order to keep the heading face pressure constant, or the pressure provided by the driving pump 23 is set to be higher than the pressure loss which occurs, with the result that the pressure loss is compensated for, with the result that no relevant change in the heading face pressure occurs. If a change in the advance occurs, the density of the mixture of boring fluid and cuttings also changes. It has been shown that this change in density has no influence on the heading face pressure, and does not necessitate any adaption of the delivery volumetric flow, of the delivery pressure, of the feed volumetric flow or of the feed pressure. Here, the delivery parameters can occur for example at maximum in the delivery characteristic of the delivery pump, which is associated with energy losses during pumping, or the delivery parameters are set below the maximum but above the normally necessary delivery parameters (pressure and volumetric flow), with the result that a corresponding leeway is present. If a limit value is then exceeded, a corresponding regulation is required.

After completion of the boring advance, the jet pump 15 is further operated until such time as cuttings no longer arise in the separation unit 31. The shut-off valve 17 is then closed, the delivery of the feed pump 22 is discontinued, and the delivery of the driving pump 23 is subsequently then discontinued, with the result that the delivery of the boring fluid through the conveying line 19 is then terminated.

FIG. 3 and FIG. 4 show a second embodiment of a device according to the invention. This differs from the embodiment according to FIGS. 1, 2 in that the feed line 13 no longer extends to the shaft 40. Furthermore, no feed pump 22 is provided. Instead, there is provided only a driving pump 23 which is connected to the jet pump 15 by a driving line 20. A control valve 27, on which the feed line 13 taps, is provided in the driving line 20 in the region of the tunnel boring device 10. As before, the feed line 13 is connected to the region of the cutting disk 11 and the section 12.

Upon starting, the boring fluid is supplied from the driving pump 23 to the jet pump 15 via the driving line 20 to the driving line connection 21. Here, the control valve 27 and the shut-off valve 17 are closed, with the result that the boring fluid, which has been delivered by the driving pump 23 to the jet pump 15, is supplied to the separation unit 31 again through the conveying line 19. First, the control valve 27 is opened to such an extent as to make available the required volumetric flow of boring fluid which is required in the region of the cutting disk, for example to provide the desired heading face pressure, and is to be supplied to the section 12. At the same time, the shut-off valve 17 is then opened, with the result that, as described above, the delivery of boring fluid and cuttings occurs through the suction line 14. Here, an adaptation of the feed volumetric flow must occur via a setting/adjustment of the control valve 27.

Upon completion of the tunnel boring advance, the region of the cutting disk 11 and of the section 12 is further supplied with boring fluid until such time as no further cuttings arise in a separation unit 31. The control valve 27 and the shut-off valve 17 are then closed, and the delivery of the boring fluid by the driving pump 23 is discontinued.

FIGS. 5, 6 show an alternative configuration of the embodiment of FIGS. 1, 2. Here, a shut-off valve 28 is provided in the feed line 13 in the region of the section 12. The shut-off valve 17 is arranged analogously thereto. A connection line 32 which has a shut-off valve 33 is provided between the feed line 13 and the suction line 14 in a section 29 between the shut-off valve 17 and suction connection 16. To start and prepare the boring, the shut-off valves 17 and 28 are closed. The shut-off valve 33 in the connection line is open. The driving pump 23 and the feed pump 22 are switched on and the boring fluid is transported through the feed line 13 and the connection line 32 to the suction connection 16 of the jet pump 15. The boring fluid supplied by the driving line 20 and the boring fluid supplied by the feed line 13 combine in the mixing chamber 25 and are conveyed away via the conveying line 19. As soon as the system has properly adjusted itself, the two shut-off valves 17 and 28 are opened and the shut-off valve 33 in the connection line 32 is closed, with the result that the jet pump 15 now sucks in from the section 12 through the suction line 14, with the region of the heading face or of the cutting disk 11 and of the section 12 being correspondingly supplied with boring fluid via the feed line 13.

The feed pump 22 charges the extraction region and the heading face until a corresponding heading face pressure prevails. Where appropriate, a readjustment via the feed pump 22 is required. The jet pump 15 now sucks in from the section 12 through the suction line 14, with the removed boring fluid being correspondingly supplied again to the region of the heading face or of the cutting disk 11 and of the section 12 via the feed line 13. The boring operation and the keeping-constant of the heading face pressure occurs as described above.

After completion of the boring operation, it is once more the case that, after no cuttings arise at the separation unit 31, the shut-off valves 17, 28, 33 are switched again in reverse order.

FIGS. 7, 8 show an alternative embodiment of FIGS. 3, 4. Here, too, there is analogously provided a corresponding connection line 32 with shut-off valve 33. Furthermore, the feed line 13 likewise has a shut-off valve 28. With the shut-off valve 33 open and the control valve 27 correspondingly adjusted, the driving pump 23 is switched on, with the result that the necessary driving volumetric flow reaches the jet pump 15 at the driving line connection 21 via the driving line 20. At the same time, the feed volumetric flow set via the control valve 27 correspondingly flows through the connection line 22 to the suction connection 16 of the jet pump 15. If the system has properly adjusted itself, the shut-off valves 17, 28 are opened and the shut-off valve 33 of the connection line 32 is closed. As a result, the feed volumetric flow of the boring fluid is transported to the cutting disk 11 or section 12 and at the same time conveyed from the section 12, while being correspondingly mixed with cuttings, via the suction line 14 to the suction connection 16 of the jet pump 15. The boring fluid together with the cuttings enters the mixing chamber 25 of the jet pump 15, is mixed there with the volumetric flow from the driving line 20 and supplied to the separation unit 31 via the mixing pipe 26 and the conveying line 19. The termination of the boring operation brings about a reverse switching order of the shut-off valves 17, 28, 33. Here, the heading face pressure is correspondingly kept constant as described above.

The jet pump as delivery pump makes it possible in a surprising manner for density fluctuations caused by the reception/suction/removal of cuttings with the boring fluid to be compensated for within the characteristic values, with the result that the heading face pressure remains substantially constant in spite of changes in the advancing rate or in the density of the cuttings.

The connection line 32 and the provision of the shut-off valves 17, 28, 33 bring about a decisive improvement during the starting of the tunnel boring device 10 to the effect that the jet pump 15 is already completely in a regulated operation and no vacuum is present at the suction connection 16. If the shut-off valves 17, 28, 33 are now switched, there immediately begins the direct transport of the boring fluid into and out of the section 12. Since the section 12 is already correspondingly filled with boring fluid, a release of the vacuum which prevails at the shut-off valve 17 if no connection line 32 is provided is thereby avoided. The release of the vacuum by actuating the shut-off valve 17 produces a sudden pressure increase in the region of the heading face, which can be correspondingly avoided by the provision of the connection line 32.

LIST OF REFERENCE SIGNS

10 tunnel boring device
11 cutting disk/boring tool
12 section
13 feed line
14 suction line
15 jet pump
16 suction connection
17 shut-off valve
18 delivery connection
19 conveying line
20 driving line
21 driving connection
22 feed pump
23 driving pump/high-pressure pump
24 driving nozzle
25 mixing chamber
26 mixing pipe
27 control valve
28 shut-off valve
29 section
30 surface installations
31 separation unit
32 connection line
33 shut-off valve
40 shaft
50 pipeline/tunnel

The invention claimed is:

1. A tunnel boring device for creating a bore from a starting point to a target point in the ground along a predefined boring line by advancing the tunnel boring device in order to create a tunnel or in order to lay a pipeline in the ground using a boring tool to break up the ground, comprising;

at least one feed line configured to supply a boring fluid to the boring tool;

at least one section disposed on the rear side of the boring tool, configured to receive the broken-up ground which is present in the form of cuttings;

at least one pump configured to remove the boring fluid mixed with the cuttings from the at least one section;

at least one conveying line configured to remove the boring fluid mixed with cuttings from the bore, the conveying line being connected to a delivery side of the at least one pump;

wherein a region of the boring tool and the at least one section are filled with boring fluid;

wherein the boring fluid in the region of the boring tool and the boring fluid disposed in the at least one section are disposed with a pressure which corresponds to the pressure prevailing in the ground at a heading face;

wherein the at least one pump is connected to the at least one section via at least one suction line;

wherein the pump is a jet pump connected to a driving line via which a driving fluid is supplied to the jet pump;

wherein the at least one pump is disposed outside the at least one section; and wherein at least one shut-off valve is disposed in the at least one suction line via which the suction line can be closed;

wherein a connection line is disposed between the feed line and the suction line;

wherein the connection line comprises a shut-off valve for closing off the connection line;

wherein a shut-off valve is disposed in the feed line;

wherein the connection line connects to the suction line between the shut-off valve in the suction line and the jet pump; and wherein the connection line connects to the feed line before the shut-off valve in the feed line.

2. The tunnel boring device as claimed in claim 1, wherein a control valve, from which the feed line leads away, is disposed in the driving line configured to set the volumetric flow of the boring fluid in the feed line.

3. The tunnel boring device as claimed in claim 1, wherein the pump is connected to a high-pressure pump via the driving line.

4. The tunnel boring device as claimed in claim 1, wherein at least one of the boring fluid or the driving fluid is a bentonite suspension.

5. The tunnel boring device as claimed in claim 4, wherein the bentonite suspension is utilized as a processed boring suspension in a circulating arrangement.

6. A system for the hydraulic removal of cuttings broken up by a tunnel boring device, comprising:

a tunnel boring device configured for wet boring with heading face pressure regulation;

a section for receiving the broken-up cuttings;

a feed line for supplying boring fluid to the section;

a suction line for removing boring fluid mixed with cuttings;

a jet pump for removing the boring fluid mixed with cuttings;

a driving line connected to a driving line connection of the jet pump, wherein driving fluid is conveyed to the jet pump by a driving pump; and a connection line between the feed line and the suction line;

wherein the suction line, the feed line and the connection line each include at least one shut-off element;

wherein the connection line connects to the suction line between the shut-off valve in the suction line and the jet pump; and wherein the connection line connects to the feed line before the shut-off valve in the feed line.

7. A system for producing a stable fluid pressure for a boring fluid in the region of a cutting disk of a tunnel boring device configured for wet boring at a heading face during the creation of a bore from a starting point to a target point in the ground along a predefined boring line by advancing the tunnel boring device to one of create a tunnel or lay a pipeline, wherein the tunnel boring device has a section behind the cutting disk for receiving cuttings released by the cutting disk, the system comprising:

a feed line for supplying boring fluid to the heading face;

a suction line for removing boring fluid mixed with cuttings from the section;

a jet pump for removing the boring fluid mixed with cuttings;

a driving line which is connected to a driving line connection of the jet pump, wherein driving fluid is conveyed to the jet pump by a driving pump; and a connection line between the feed line and the suction line, wherein at least one shut-off element is provided in each case in the suction line, the feed line and the connection line;

wherein the connection line connects to the suction line between the shut-off valve in the suction line and the jet pump; and wherein the connection line connects to the feed line before the shut-off valve in the feed line.

* * * * *